US011952184B2

(12) United States Patent
Hession et al.

(10) Patent No.: US 11,952,184 B2
(45) Date of Patent: Apr. 9, 2024

(54) MULTI-CHAMBERED CONTAINER

(71) Applicant: Altria Client Services LLC, Richmond, VA (US)

(72) Inventors: Christopher J. Hession, Mechanicsville, VA (US); Christopher L. Simpson, Richmond, VA (US)

(73) Assignee: Altria Client Services LLC, Richmond, VA (US)

( * ) Notice: Subject to any disclaimer, the term of this patent is extended or adjusted under 35 U.S.C. 154(b) by 0 days.

(21) Appl. No.: 17/848,602

(22) Filed: Jun. 24, 2022

(65) Prior Publication Data

US 2022/0315298 A1 Oct. 6, 2022

Related U.S. Application Data

(63) Continuation of application No. 17/087,012, filed on Nov. 2, 2020, now Pat. No. 11,377,274.

(51) Int. Cl.

| | |
|---|---|
| ***B65D 51/18*** | (2006.01) |
| ***A24F 23/00*** | (2006.01) |
| ***B65D 41/04*** | (2006.01) |
| ***B65D 41/16*** | (2006.01) |
| ***B65D 51/28*** | (2006.01) |

(52) U.S. Cl.

CPC ..... *B65D 51/18* (2013.01); *A24F 23/00* (2013.01); *B65D 41/04* (2013.01); *B65D 41/16* (2013.01); *B65D 51/28* (2013.01); *B65D 2251/0015* (2013.01); *B65D 2251/0078* (2013.01)

(58) Field of Classification Search

CPC ..... B65D 51/18; B65D 51/28; B65D 2251/0015; B65D 2251/0078; B65D 41/16; A24F 23/00

USPC ..... 206/265, 581, 236; 220/254.1, 8, 256.1, 220/259.3

See application file for complete search history.

(56) References Cited

U.S. PATENT DOCUMENTS

| | | | | |
|---|---|---|---|---|
| 3,664,536 | A | 5/1972 | Emery | |
| 4,553,679 | A | 11/1985 | Hatakeyama et al. | |
| 4,591,050 | A * | 5/1986 | Finke | B65D 51/28 215/DIG. 8 |
| 4,765,499 | A | 8/1988 | von Reis et al. | |
| 8,567,597 | B2 | 10/2013 | Gibson et al. | |
| 8,701,881 | B2 | 4/2014 | Gibson et al. | |
| 8,869,980 | B2 | 10/2014 | Berggren | |
| 10,112,743 | B2 | 10/2018 | Beardsall | |
| 10,463,075 | B2 | 11/2019 | Beardsall | |
| 11,377,274 | B2 * | 7/2022 | Hession | B65D 51/28 |
| 2005/0040052 | A1 | 2/2005 | Dixon | |
| 2008/0283528 | A1 | 11/2008 | Solovyev et al. | |

(Continued)

FOREIGN PATENT DOCUMENTS

WO WO-201196257 A1 8/2011

*Primary Examiner* — Rafael A Ortiz
*Assistant Examiner* — Sanjidul Islam
(74) *Attorney, Agent, or Firm* — Harness, Dickey & Pierce, P.L.C.

(57) ABSTRACT

A container is configured to house a consumer product. The container includes a base, a cap, and an over-cap. The base has a bottom wall and a side wall extending from the bottom wall. The cap is engaged with the base so as to define a first compartment. The first compartment is configured to house the consumer product. The over-cap is engaged with the base and at least partially defines a second compartment.

18 Claims, 9 Drawing Sheets

(56) References Cited

U.S. PATENT DOCUMENTS

| | | | |
|---|---|---|---|
| 2012/0073590 | A1 | 3/2012 | Kawata et al. |
| 2012/0187124 | A1 | 7/2012 | Chang |
| 2016/0073679 | A1 | 3/2016 | Rushforth et al. |
| 2017/0369223 | A1 | 12/2017 | Beardsall |
| 2018/0155097 | A1 | 6/2018 | Hinnerud et al. |
| 2018/0168222 | A1 | 6/2018 | Nersing et al. |

* cited by examiner

MULTI-CHAMBERED CONTAINER

CROSS-REFERENCE TO RELATED APPLICATIONS

This application is a continuation of U.S. application Ser. No. 17/087,012, filed Nov. 2, 2020, the entire contents of which is hereby incorporated by reference thereto.

BACKGROUND

Field

The present disclosure relates to a container having multiple chambers or storage compartments.

Description of Related Art

Consumer products, such as tobacco, may be sold in loose form or packets. The packets may contain portions of loose tobacco disposed in permeable bags. The loose tobacco and packets may be packaged in portable containers having reusable (or re-sealable) lids to maintain the moisture of the tobacco during transport, storage, display, and use of the product.

SUMMARY

At least one example embodiment relates to a container configured to house a consumer product. The container includes a base, a cap, and an over-cap. The base has a bottom wall and a side wall extending from the bottom wall. The cap is engaged with the base so as to define a first compartment. The first compartment is configured to house the consumer product. The over-cap is engaged with the base and at least partially defines a second compartment.

In at least one example embodiment, the bottom wall of the base may be circular and the side wall of the base may be cylindrical.

In at least one example embodiment, an outer surface of an over-cap side wall may be flush with an outer surface of the side wall of the base.

In at least one example embodiment, the consumer product may be a tobacco product.

In at least one example embodiment, the consumer product may be a smokeless tobacco.

In at least one example embodiment, the over-cap may be engaged with both the cap and the base so as to define the second compartment.

In at least one example embodiment, the second compartment may be above the first compartment.

In at least one example embodiment, an open end of the side wall of the base may include a first neck portion and a second neck portion. Each of the first neck portion and the second neck portion may have a wall thickness less than a wall thickness of the side wall of the base. The wall thickness of the first neck portion may be less than the wall thickness of the second neck portion.

In at least one example embodiment, the cap may include a cap top wall, a first cap side wall extending from a bottom surface of the cap top wall, and a second cap sidewall extending from a top surface of the cap top wall. The first cap side wall and the cap top wall may define a first space adjacent the bottom surface of the cap top wall. The second cap side wall and the cap top wall may define a second space adjacent the top surface of the cap top wall.

In at least one example embodiment, an outer surface of the first cap side wall and an outer surface of the second cap side wall may engage an inner surface of the first neck portion of the base.

In at least one example embodiment, an inner surface of the first cap side wall extending from the bottom surface of the cap top wall may engage an outer surface of the first neck portion of the base.

In at least one example embodiment, a thickness of the first cap side wall plus the thickness of the first neck portion may be equal to the thickness of the second neck portion.

In at least one example embodiment, the cap top wall of the cap may be circular. The first cap side wall may be cylindrical. The second cap side wall may be cylindrical.

In at least one example embodiment, the over-cap may include an over-cap top wall and an over-cap side wall may extend from a bottom surface of the over-cap top wall. The over-cap top wall and the over-cap side wall may define a space on the bottom surface of the over-cap top wall. An inner surface of the over-cap side wall may engage with the second neck portion of the base and outer surfaces of the first cap side wall and the second cap side wall.

In at least one example embodiment, a thickness of the over-cap side wall plus the thickness of the first cap side wall plus the thickness of the first neck portion may be equal to the thickness of the side wall of the base.

In at least one example embodiment, the over-cap may include an over-cap top wall and an over-cap side wall extending from a bottom surface of the over-cap top wall. The over-cap top wall and the over-cap side wall may define a space adjacent the bottom surface of the over-cap top wall.

In at least one example embodiment, an inner surface of the over-cap side wall may be engaged with the second neck portion of the base.

In at least one example embodiment, a thickness of the over-cap side wall plus the thickness of the second neck portion of the base may be equal to the thickness of the side wall of the base.

In at least one example embodiment, the over-cap top wall may be circular, and the over-cap side wall may be cylindrical.

In at least one example embodiment, the cap may be press-fit on the base, and the over-cap may be press-fit on the cap and base.

In at least one example embodiment, the cap may be threadably engaged with the base and the over-cap may be press-fit on the cap and the base.

BRIEF DESCRIPTION OF THE DRAWINGS

The various features and advantages of the non-limiting embodiments herein may become more apparent upon review of the detailed description in conjunction with the accompanying drawings. The accompanying drawings are merely provided for illustrative purposes and should not be interpreted to limit the scope of the claims. The accompanying drawings are not to be considered as drawn to scale unless explicitly noted. For purposes of clarity, various dimensions of the drawings may have been exaggerated.

Corresponding reference numerals indicate corresponding parts throughout the several views of the drawings.

DETAILED DESCRIPTION

Figure 1A:
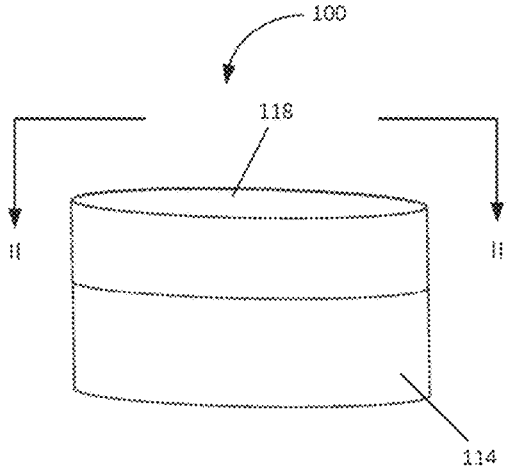
FIG. 1A is a perspective view of a container according to at least one example embodiment.

Some detailed example embodiments are disclosed herein. However, specific structural and functional details disclosed herein are merely representative for purposes of describing example embodiments. Example embodiments may, however, be embodied in many alternate forms and should not be construed as limited to only the example embodiments set forth herein.

Accordingly, while example embodiments are capable of various modifications and alternative forms, example embodiments thereof are shown by way of example in the drawings and will herein be described in detail. It should be understood, however, that there is no intent to limit example embodiments to the particular forms disclosed, but to the contrary, example embodiments are to cover all modifications, equivalents, and alternatives falling within the scope of example embodiments. Like numbers refer to like elements throughout the description of the figures.

It should be understood that when an element or layer is referred to as being "on," "connected to," "coupled to," or "covering" another element or layer, it may be directly on, connected to, coupled to, or covering the other element or layer or intervening elements or layers may be present. In contrast, when an element is referred to as being "directly on," "directly connected to," or "directly coupled to" another element or layer, there are no intervening elements or layers present. Like numbers refer to like elements throughout the specification. As used herein, the term "and/or" includes any and all combinations or sub-combinations of one or more of the associated listed items.

It should be understood that, although the terms first, second, third, etc. may be used herein to describe various elements, regions, layers and/or sections, these elements, regions, layers, and/or sections should not be limited by these terms. These terms are only used to distinguish one element, region, layer, or section from another region, layer, or section. Thus, a first element, region, layer, or section discussed below could be termed a second element, region, layer, or section without departing from the teachings of example embodiments.

Spatially relative terms (e.g., "beneath," "below," "lower," "above," "upper," and the like) may be used herein for ease of description to describe one element or feature's relationship to another element(s) or feature(s) as illustrated in the figures. It should be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the term "below" may encompass both an orientation of above and below. The device may be otherwise oriented (rotated 90 degrees or at other orientations) and the spatially relative descriptors used herein interpreted accordingly.

The terminology used herein is for the purpose of describing various example embodiments only and is not intended to be limiting of example embodiments. As used herein, the singular forms "a," "an," and "the" are intended to include the plural forms as well, unless the context clearly indicates otherwise. It will be further understood that the terms "includes," "including," "comprises," and/or "comprising," when used in this specification, specify the presence of stated features, integers, steps, operations, and/or elements, but do not preclude the presence or addition of one or more other features, integers, steps, operations, elements, and/or groups thereof.

When the terms "about" or "substantially" are used in this specification in connection with a numerical value, it is intended that the associated numerical value includes a manufacturing or operational tolerance (e.g., ±10%) around the stated numerical value. Moreover, when the words "generally" or "substantially" are used in connection with geometric shapes, it is intended that precision of the geometric shape is not required but that latitude for the shape is within the scope of the disclosure. Further, regardless of whether numerical values or shapes are modified as "about" or "substantially," it will be understood that these values and shapes should be construed as including a manufacturing or operational tolerance (e.g., ±10%) around the stated numerical values or shapes.

Unless otherwise defined, all terms (including technical and scientific terms) used herein have the same meaning as commonly understood by one of ordinary skill in the art to which example embodiments belong. It will be further understood that terms, including those defined in commonly used dictionaries, should be interpreted as having a meaning that is consistent with their meaning in the context of the relevant art and will not be interpreted in an idealized or overly formal sense unless expressly so defined herein.

Example embodiments are described herein with reference to cross-sectional illustrations that are schematic illustrations of idealized embodiments (and intermediate structures) of example embodiments. As such, variations from the shapes of the illustrations as a result, for example, of manufacturing techniques and/or tolerances, are to be expected. Thus, example embodiments should not be construed as limited to the shapes of regions illustrated herein but are to include deviations in shapes that result, for example, from manufacturing.

At least one example embodiment relates to a container having a dual cap. The dual cap includes a cap and an over-cap defining a disposal or storage compartment, providing additional storage space to, and separate from, the container. The over-cap or cap may include child-resistant features, such as a press-and-twist cover or lid. As an example, the container may be used to house a consumer product, such as loose tobacco or tobacco packets, and the dual cap may provide a disposal compartment to store used tobacco or tobacco packets.

FIG. 1A is a perspective view of a container according to at least one example embodiment.

Referring to FIG. 1A, in at least one example embodiment, a container 100 includes a base 114 and an over-cap 118. The over-cap 118 may be removably fixed to the base 114 such that the over-cap 118 may be engaged with the base 114 in a closed position and disengaged with the base 114 in an open position. In at least one example embodiment, the over-cap 118 may be press-fit onto the base 114. In at least one alternative example embodiment, the over-cap 118 may be threadably engaged on the base 114.

In at least one example embodiment, the container 100 may be a generally cylindrical container. While the container 100 is illustrated as a cylindrical container, it is understood that the container 100 may have any cross-sectional shape, such as rectangular, triangular, hexagonal, elliptical, or any other cross-sectional shape. In at least one example embodiment, the base 114 and the over-cap 118 may each include circular cross-sections, such that when the over-cap 118 is engaged to the base 114, the container 100 is a cylindrical container. While the base 114 and over-cap 118 are illustrated as having circular cross-sections, it is understood that the base 114 and over-cap 118 may have any cross-sectional shape, such as rectangular, triangular, hexagonal, elliptical, etc., as long as the cross-sectional shape of the over-cap 118 is the same as the cross-sectional shape of the base 114.

In at least one example embodiment, a diameter of the base 114 may be equal to a diameter of the over-cap 118. In at least one example embodiment, the diameter of the base 114 and the diameter of the over-cap 118 may each be within a range of about 50 mm to about 100 mm. More particularly, in at least one example embodiment, the diameter of the base 114 and the diameter of the over-cap 118 may each be about 66 mm (plus or minus 3 mm). However, it is understood that the disclosure is not limited to these ranges, and containers having larger or smaller diameters are envisioned.

In at least one example embodiment, the base 114 and the over-cap 118 may be formed of the same material. In at least one example embodiment, the base 114 and the over-cap 118 may be formed of different materials. In at least one example embodiment, the base 114 and the over-cap 118 may be formed of a moldable polymer (such as polypropylene or plastic), a fiberboard, a metallic material (e.g., aluminum, tin, stainless steel, or the like), a combination of materials, or any other suitable material or combination thereof. In at least one example embodiment, an interior of the container 10 may be coated with a wax or other food-grade coating.

In at least one example embodiment, the base 114 and/or over-cap 118 of the container 100 may be formed by injection molding, blow molding, thermoforming, compression molding, vacuum casting, or any other polymer forming process. In at least one example embodiment, the base 114 and/or over-cap 118 of the container 100 may be formed by rolling, stamping, another metalworking procedure, or a combination of these. In at least one example embodiment, the base 114 and/or over-cap 118 of the container 100 may be formed by hot press molding and drying, or any other fiberboard molding process.

In at least one example embodiment, the container 100 may house an oral product. The oral product may be a tobacco product or a non-tobacco product. The oral product may include chewing tobacco, snus, moist snuff tobacco, dry snuff tobacco, or other smokeless tobacco and/or non-tobacco products for oral consumption. A smokeless tobacco product may include tobacco that is whole, shredded, cut, granulated, reconstituted, cured, aged, fermented, pasteurized, or otherwise processed. Tobacco may be present as portions of leaves, flowers, roots, stems, extracts, or any combination thereof. In at least one example embodiment, the oral product includes a tobacco extract, such as a tobacco-derived nicotine extract (e.g., white snus) alone or in combination with non-tobacco cellulosic materials. Where the oral product includes nicotine, with or without tobacco, the nicotine may be tobacco-derived nicotine or synthetic nicotine. The oral product may be provided loose, in a pouch, as a plug or twist, or in a desired shape.

The oral product may have various ranges of moisture. In at least one example embodiment, the oral product is a dry oral product having a moisture content ranging from 5% by weight to 10% by weight. In at least one example embodiment, the oral product has a medium moisture content, such as a moisture content ranging from 20% by weight to 35% by weight. In at least one example embodiment, the oral product is a wet oral product having a moisture content ranging from 40% by weight to 55% by weight.

The tobacco products may include smokeless tobacco pouches, for example. The non-tobacco products may include herbal compositions, pharmaceutical medications, or other non-tobacco products. Herbs and other edible plants can be categorized generally as culinary herbs (e.g., thyme, lavender, rosemary, coriander, dill, mint, peppermint) and medicinal herbs (e.g., Dahlias, Cinchona, Foxglove, Meadowsweet, Echinacea, Elderberry, Willow bark). In some example embodiments, the non-tobacco products may include cannabis or cannabis extracts.

Figure 1B:
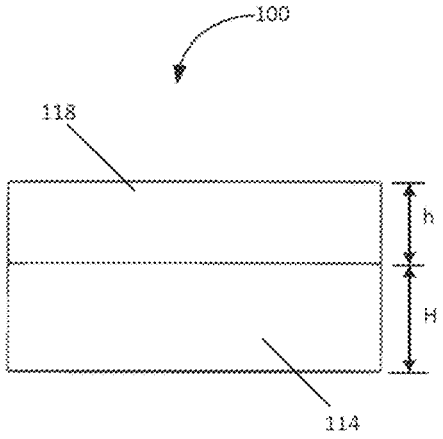
FIG. 1B is a front view of the container shown in FIG. 1A.

FIG. 1B is a front view of the container shown in FIG. 1A. FIG. 1B is generally the same as FIG. 1A, but includes the features of the container 100, base 114, and over-cap 118 in a different view to provide a different perspective.

In at least one example embodiment, a height h of the over-cap 118 may be less than a height H of the base 114. For example, the height h of the over-cap 118 may be within a range of 0.25 to 0.8 times the height H of the base 114. In at least one example embodiment, the height h of the over-cap 118 may be within a range of about 5 mm to about 25 mm, and the height H of the base 114 may be within a range of about 20 mm to about 50 mm. While the height h of the over-cap 118 is illustrated and discussed as being less than the height H of the base, 114, it is understood that the disclosure is not limited to this example. In at least one example embodiment, the height h of the over-cap 18 may be equal to or greater than the height H of the base 14.

Figure 2:
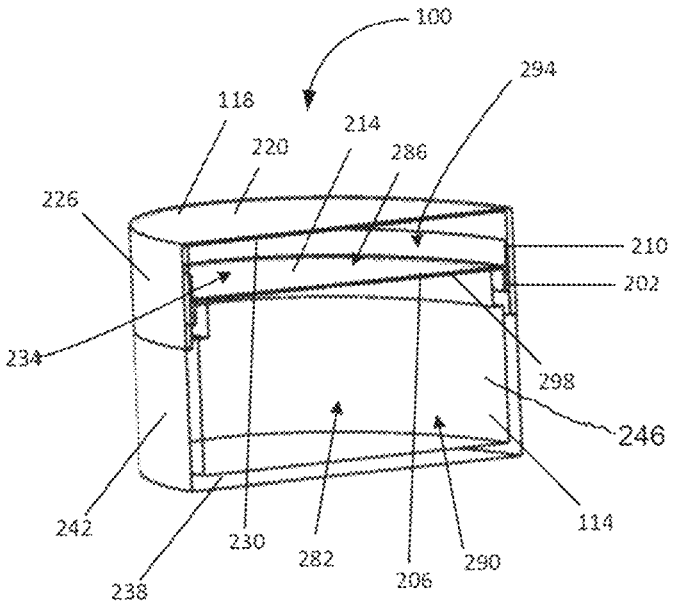
FIG. 2 is a perspective cross-sectional view of at least one example embodiment of a section of the container shown in FIG. 1A along line II-II.

FIG. 2 is a perspective cross-sectional view of at least one example embodiment of a section of the container shown in FIG. 1A along line II-II.

In at least one example embodiment, the over-cap 118 may include an over-cap top wall 220 and an over-cap side wall 226. The over-cap side wall 226 may project from a bottom surface 230 of the over-cap top wall 220 to create a space, or recess, 234 defined by the bottom surface 230 and over-cap side wall 226.

The over-cap top wall 220 may have a circular shape and the over-cap side wall 226 may be a cylindrical, or tubular, defining the cylindrical recess 234 therein. While the over-cap 118 is illustrated as being a cylindrical shape with a circular closed end (or over-cap top wall 220), it is understood that the over-cap 118 may take on any shape (for example, a circle, a rectangle, a square, a triangle, a polygon, etc.) that mates with a cross-sectional shape of the base 114.

In at least one example embodiment, the base 114 may include a bottom wall 238 and side wall 242 that define a recess 246 in the base 114. In at least one example embodiment, the side wall 242 may be a cylindrical, or tubular, side wall 242 terminating in a circular bottom wall 238 and defining the cylindrical recess, or open cavity, 246 therein. While the side wall 242 may be illustrated and discussed as a cylindrical side wall 242, it is understood that the side wall 242 may be any shape (for example, an ellipse, a rectangle, a square, a triangle, a polygon, etc.) that mates with a shape of the over-cap 118. Further, while the bottom wall 238 may be illustrated and discussed as a circular bottom wall 238, it is understood that the bottom wall 238 may be any shape (for example, an ellipse, a rectangle, a square, a triangle, a polygon, etc.) that corresponds to a cross-sectional shape of the side wall 242.

In at least one example embodiment, the over-cap 118 may be connected to the base 114 to define a cavity 282 therein. In at least one example embodiment, a cap 286 may function as a partition to divide the cavity 282 into a first compartment 290 and a second compartment 294. The cap 286 may include a panel, or barrier, 298 that may be formed in a same shape as the over-cap top wall 220, the bottom wall 238, and a cross-section of the cavity 282 defined by the over-cap 118 and base 114. In at least one example embodiment, the cap 286 may additionally include a first side wall 202 extending from a bottom surface 206 of the panel 298 and a second side wall 210 extending from a top surface 214 of the panel 298.

Figure 3:
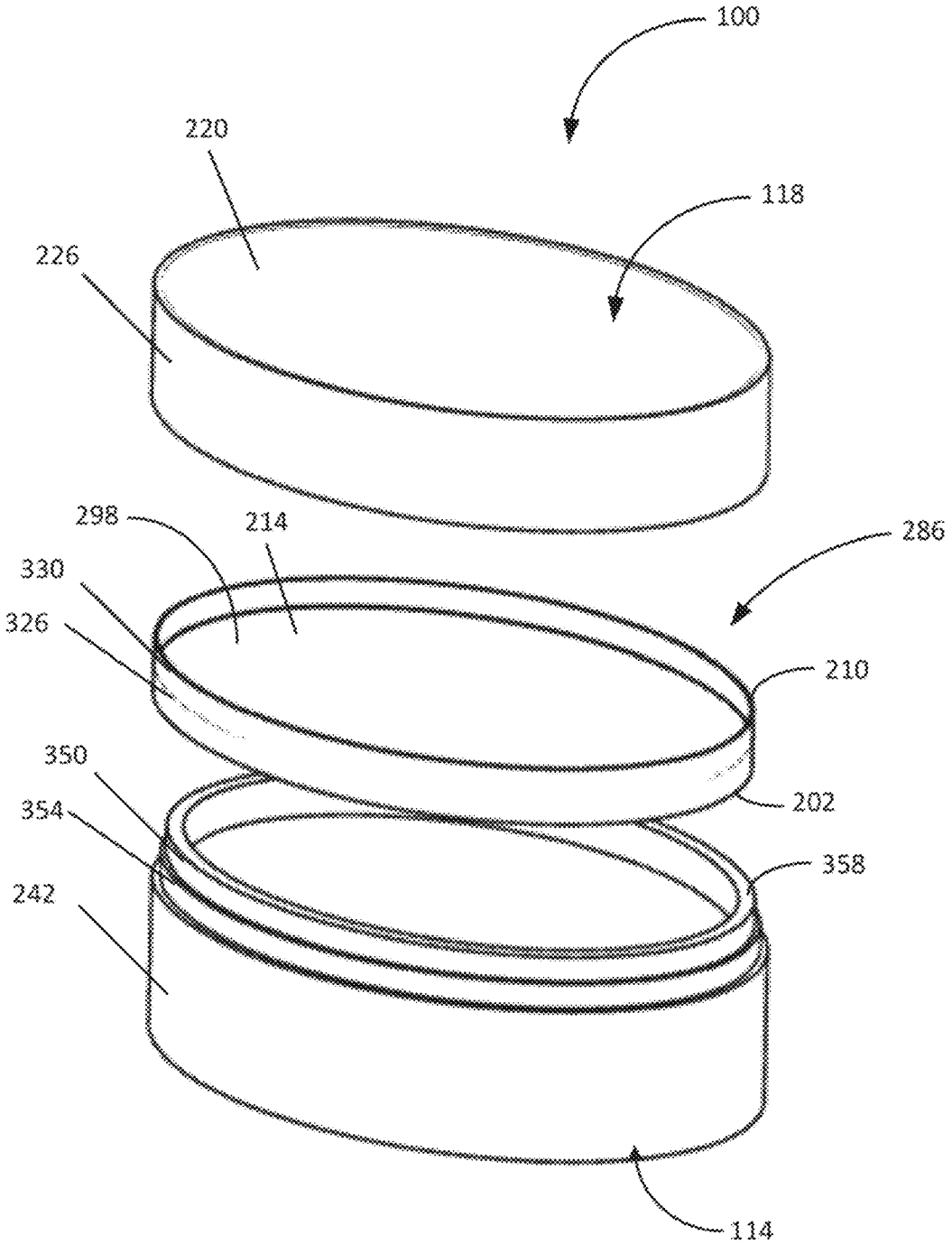
FIG. 3 is an exploded view of at least one example embodiment of the container shown in FIG. 1A.

FIG. 3 is an exploded view of at least one example embodiment of the container shown in FIG. 1A.

In at least one example embodiment, an outer surface 326 of the first side wall 202 of the cap 286 may be flush with an outer surface 330 of the second side wall 210 of the cap 286. As illustrated in FIG. 3, the first side wall 202 of the cap 286 and the second side wall 210 of the cap 286 may each be a cylindrical, or tubular, side wall divided by the panel 298 having a circular shape. While the side walls 202, 210 may be illustrated and discussed as cylindrical side walls, it is understood that the side walls 202, 210 may be any shape (for example, an ellipse, a rectangle, a square, a triangle, a polygon, etc.) that mates with a shape of the other side wall 202, 210 and a shape of the base 114 and over-cap 118.

Figure 4:
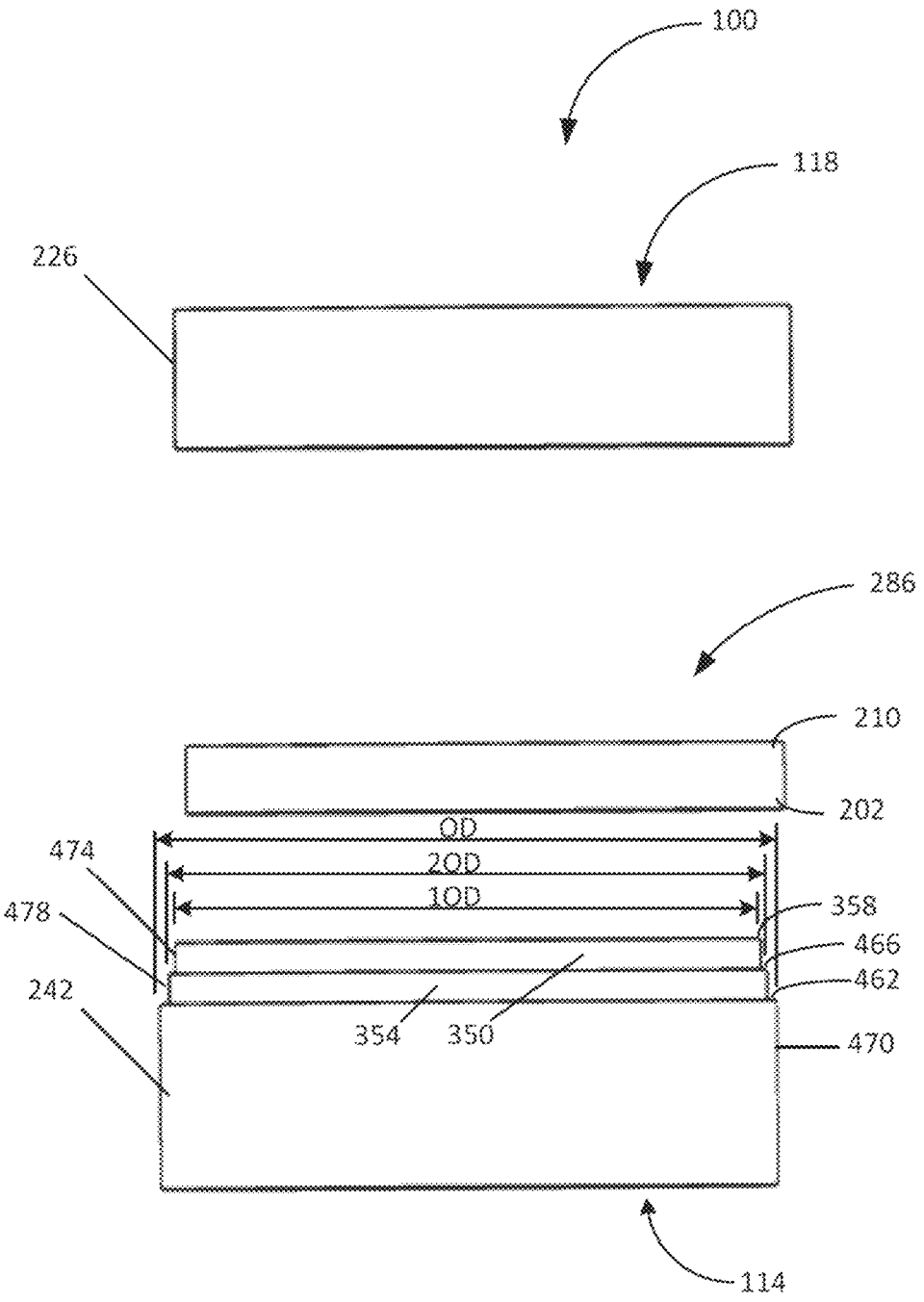
FIG. 4 is an exploded view of at least one example embodiment of the container shown in FIG. 3.

In at least one example embodiment, the base 114 may include a first neck portion, or first neck, 350 and a second neck portion, or second neck, 354 on an open end 358 of the side wall 242. The first neck portion 350 may be closer to the open end 358 of the side wall 242 than the second neck portion 354, and the first neck portion 350 may be directly adjacent to, or abutting, the second neck portion 354. In at least one example embodiment, the first neck 350, as further discussed below, may be configured to engage with the cap 286, and, more particularly, the first neck 350 may be configured to engage with the first side wall 202 of the cap 286. FIG. 4 is an exploded view of at least one example embodiment of the container shown in FIG. 1A. FIG. 4 is generally the same as FIG. 3, but includes the features of the container 100 in a different view to provide a different perspective.

In at least one example embodiment, the first neck portion 350 may include a first neck outer diameter 1OD, and the second neck portion 354 may include a second neck outer diameter 2OD. The first neck outer diameter 1OD and the second neck outer diameter 2OD may be the outer diameters of the respective neck portions. In at least one example embodiment, the diameter OD of the side wall 242 is greater than the second neck outer diameter 2OD. The second neck outer diameter 2OD is greater than the first neck outer diameter 1OD.

The differences in outer diameters of the first neck portion 350, the second neck portion 354, and the side wall 242 create a first step 462 (or annular surface) and a second step 466 (or annular surface). The first step 462 is formed in an outer surface 470 of the side wall 242, an outer surface 474 of the first neck portion 350, and an outer surface 478 of the second neck portion 354. A depth of the first step 462 may equal a difference between the outer diameter OD of the side wall 242 and the second neck outer diameter 20D of the second neck portion 354. A depth of the second step 466 may equal a difference between the second neck outer diameter 2OD of the second neck portion 354 and the first neck outer diameter 1OD of the first neck portion 350.

Figure 5:
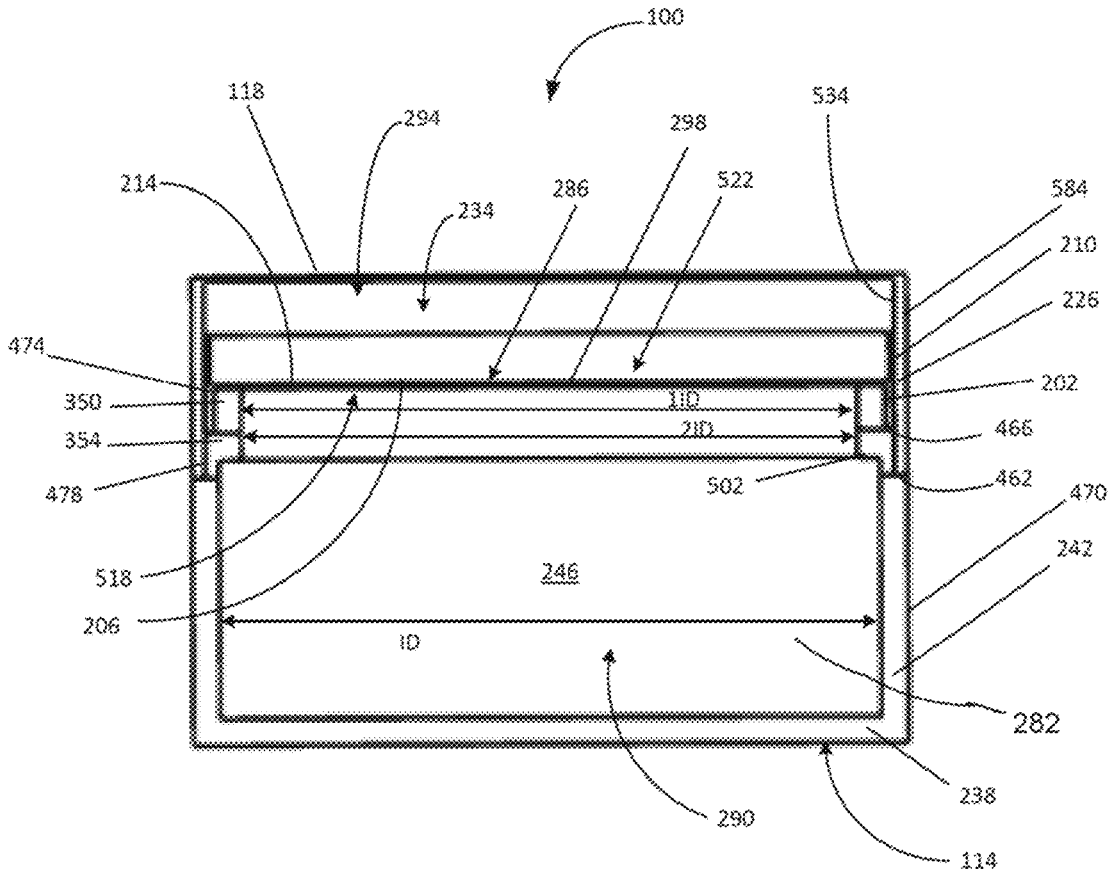
FIG. 5 is a cross-sectional view along line II-II of the example embodiment of the section of the container shown in FIG. 1A.

FIG. 5 is another cross-sectional view taken along line II-II of the example embodiment of the section of the container shown in FIG. 1A. FIG. 5 is generally the same as FIG. 4, but includes the features of the container 100 in a different view to provide a different perspective.

In at least one example embodiment, an inner diameter 1ID of the first neck portion 350 and an inner diameter 2ID of the second neck portion 354 may remain constant to create a smooth inner surface in the base 114. The inner diameters 1ID and 2ID may be less than an inner diameter ID of the side wall 242 of the base 114 such that a ledge 502 is created opposite the first step 462.

In at least one alternative example embodiment, the inner diameter HD of the first neck portion 350, the inner diameter 2ID of the second neck portion 354, and the inner diameter ID of the side wall 242 may be different with the first inner diameter 1ID being less than the inner diameter ID and the second inner diameter 2ID having a stepped portion, decreasing from the inner diameter ID to the first inner diameter 1ID.

In at least one example embodiment, the over-cap 118 may be connected to the base 114 to define the cavity 282 therein. The over-cap side wall 226 may be press-fit onto the second neck portion 354 to retain the over-cap 118 on the base 114. For example, the over-cap side wall 226 may be press-fit onto the second neck portion 354 until the over-cap side wall 226 abuts or engages the first step 462. When the over-cap 118 is assembled on the base 114, an outer surface 584 of the over-cap side wall 226 may be flush with the outer surface 470 of the side wall 242 of the base 114.

In at least one example embodiment, the cavity 282 defined by the over-cap 118 and base 114 may be used for storing the consumer product.

In at least one example embodiment, the first side wall 202 and the second side wall 210 may be cylindrical sidewalls. The first side wall 202 may cooperate with the panel 298 to define a first space 518 on the bottom surface 206. The second side wall 210 may cooperate with the panel 298 to define a second space 522 on the top surface 214.

In at least one example embodiment, when assembled, the cap 286 may be disposed between the over-cap 118 and the base 114. The first side wall 202 may engage with, or abut, the first neck portion 350. In this arrangement, the first side wall 202 may be seated in the second step 466 between the first neck portion 350 and the second neck portion 354. The outer surface 326 (also shown in FIG. 3) of the first side wall 202, the outer surface 330 (also shown in FIG. 3) of the second side wall 210, and the outer surface 478 of the second neck portion 354 may be flush.

The over-cap 118 may also be press-fit on the cap 286 and base 114. For example, an inner surface 534 of the over-cap side wall 226 may engage the outer surface 326 of the first side wall 202 and the outer surface 330 of the second side wall 210, along with the outer surface 478 of the second neck portion 354. Accordingly, the cap 286 may be in a press-fit arrangement with the over-cap 118, such that when the over-cap 118 is removed from the base 114 the cap 286 is also removed from the base 114 and remains engaged with the over-cap 118.

Figure 6:
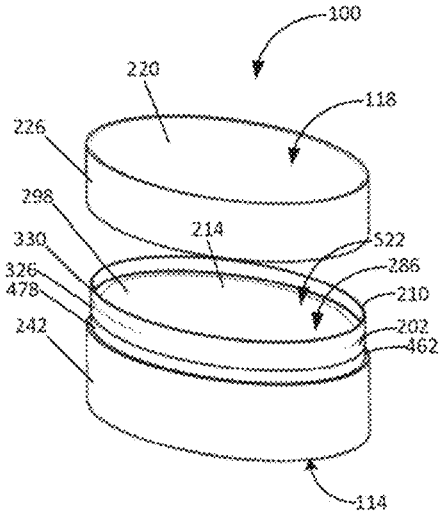
FIG. 6 is a perspective view of at least one example embodiment of the container shown in FIG. 1A with an over-cap removed.

FIG. 6 is a perspective view of at least one example embodiment of the container shown in FIG. 1A with the over-cap removed.

As previously mentioned, in at least one example embodiment, the cap 286 acts as a partition to divide the cavity 282 into the first compartment 290 and the second compartment 294. The first compartment 290 is defined by the panel 298, the first side wall 202, and the base 114. The second compartment 294 is defined by the panel 298, the second side wall 210, and the over-cap 118. In at least one example embodiment, the first compartment 290 may store the consumer product, as previously mentioned. In at least one example embodiment, the second compartment 294 may be the disposal or storage compartment. Because of the press-fit arrangement, the disposal or storage compartment, i.e. second compartment 294, remains hidden unless purposefully accessed. Thus, the consumer product may be accessed in the first compartment 290 without having to see the contents of the second compartment 294, and without having to manipulate the cap 286.

Figure 7:
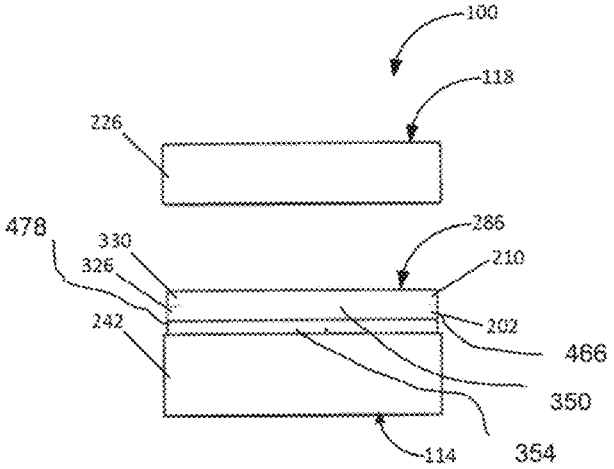
FIG. 7 is a front view of at least one example embodiment of the container shown in FIG. 6 with an over-cap removed.

FIG. 7 is a front view of at least one example embodiment of the container shown in FIG. 1A with the over-cap 118 removed. FIG. 7 is generally the same as FIG. 6, but includes the features of the container 100 in a different view to provide a different perspective.

As shown in FIG. 7, in at least one example embodiment, when assembled, the cap 286 may be disposed on the first neck portion 350 of the base 114. More specifically, the first side wall 202 may engage with, or abut, the first neck portion 350. In this arrangement, the first side wall 202 may be seated in the second step 466 between the first neck portion 350 and the second neck portion 354. The outer surface 326 of the first side wall 202, the outer surface 330 of the second side wall 210, and the outer surface 478 of the second neck portion 354 may be flush.

Figure 8:
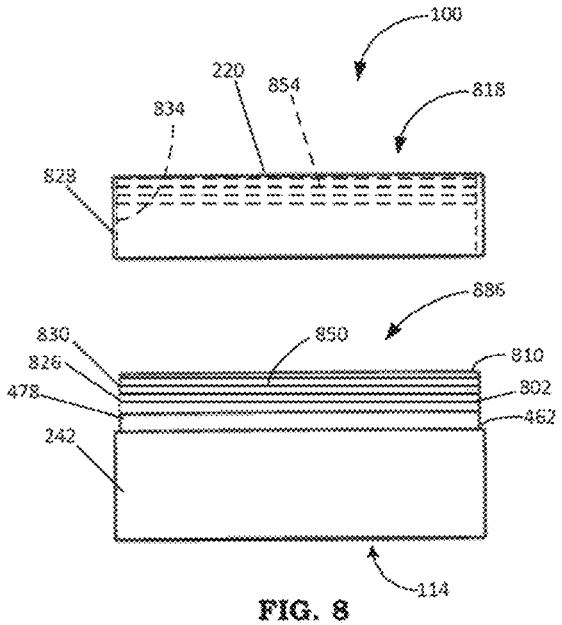
FIG. 8 is a front view of at least one example embodiment of the container shown in FIG. 1A with an over-cap removed.

FIG. 8 is a front view of at least one example embodiment of the container shown in FIG. 1A with an over-cap 818 removed from the base 114. The example embodiment of FIG. 8 is the same as the example embodiment of FIG. 7, except that FIG. 8 illustrates an alternative example embodiment of an over-cap 818 and a cap 886.

In at least one example embodiment, the container 100 may include an over-cap 818, the base 114, and a cap 886. The over-cap 818, base 114, and cap 886 may be the same as, or similar to, the over-cap 118, the base 114, and the cap 286 of the container 100 except as described below.

In at least one example embodiment, the cap 886 may be threadably engaged to the over-cap 818. For example, an outer surface 826 of a first cap side wall 802 and an outer surface 830 of a second cap side wall 810 may include threads 850. Threads 850 may engage with threads 854 on an inner surface 834 of the over-cap side wall 828 of the over-cap 818.

Figure 9:
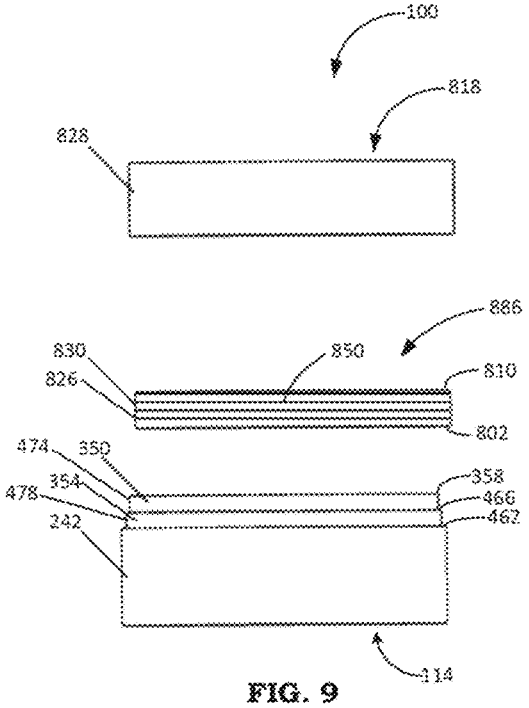
FIG. 9 is an exploded view of at least one example embodiment of the container shown in FIG. 8.

FIG. 9 is an exploded view of at least one example embodiment of the container shown in FIG. 8. FIG. 9 is generally the same as FIG. 8, but includes the features of the container 100 in a different view to provide a different perspective.

As illustrated in FIG. 9, in at least one example embodiment, the cap 886 may be in a press-fit arrangement with the base 114, such that the first cap side wall 802 is press-fit onto the first neck portion 350. The over-cap 818 may threadably engage with the cap 886 and may be in a press-fit arrangement with the base 114. More specifically, in at least one example embodiment, the over-cap side wall 828 may be threadably engaged with the outer surfaces 826, 830 of the first and second cap side walls 802, 810, respectively, and then be press fit on the outer surface 478 of the second neck portion 354.

In at least one example embodiment, when the over-cap 818 is removed from the base 114, the cap 886 remains threadably engaged with the over-cap 818 and is also removed from the base 114, exposing the cavity 282. For access to the second compartment 294, the cap 886 is unthreaded from the over-cap 818.

Because of the threaded arrangement, the disposal or storage compartment, i.e. second compartment 294, remains hidden unless purposefully accessed. Thus, the consumer product may be accessed in the first compartment 290 without having to see the contents of the second compartment 294, and without having to manipulate the cap 886.

Figure 10:
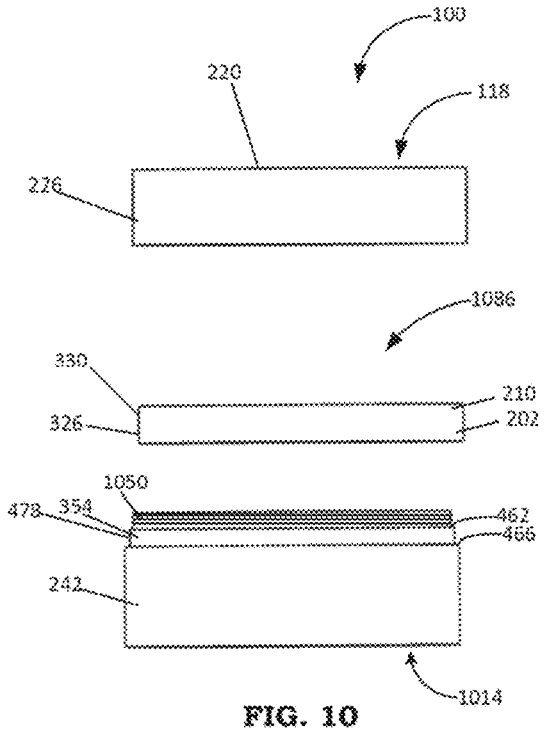
FIG. 10 is an exploded view of at least one example embodiment of the container shown in FIG. 1A.

FIG. 10 is an exploded view of at least one example embodiment of the container 100 shown in FIG. 1A. The example embodiment of FIG. 10 is the same as the example embodiment of FIG. 7, except that FIG. 10 illustrates an alternative example embodiment of a cap 1086 and a base 1014.

In at least one example embodiment, the container 100 may include the over-cap 118, the base 1014, and the cap 1086. The over-cap 118, base 1014, and cap 1086 may be the same as, or similar to, the over-cap 118, the base 114, and the cap 286 of the container 100 except where described below.

In at least one example embodiment, the cap 1086 may be threadably engaged to the base 1014. More specifically, the cap 1086 may be threadably engaged with the first neck portion 1050 of the base 1014 such that the first cap side wall 202 rests on the step 462 and the outer surfaces 126, 130 of the first and second cap side walls 202, 210, respectively, are flush with the outer surface 478 of the second neck portion 354.

Figure 11:
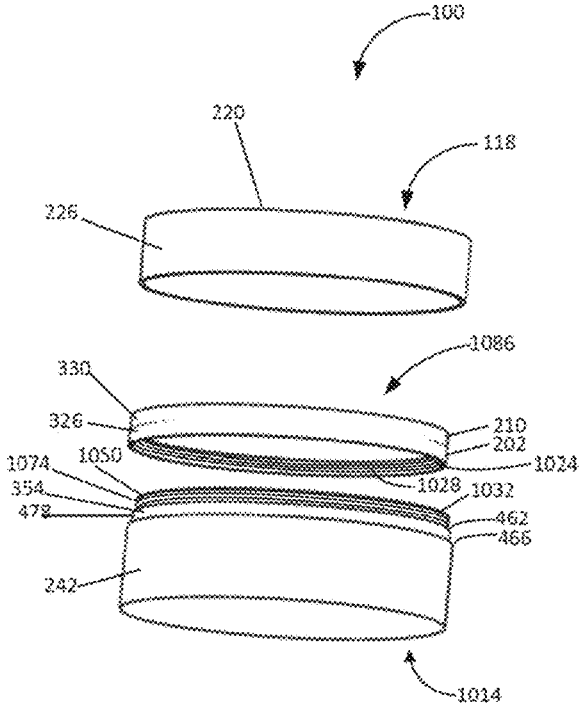
FIG. 11 is a perspective exploded view of at least one example embodiment of the container shown in FIG. 10.

FIG. 11 is a perspective exploded view of at least one example embodiment of the container 100 shown in FIG. 10. FIG. 11 is generally the same as FIG. 10, but includes the features of the container 100 in a different view to provide a different perspective.

For example, an inner surface 1024 of the first cap side wall 202 may include threads 1028. Threads 1028 may engage with threads 1032 on the outer surface 1074 of the first neck portion 1050 of the base 1014.

In at least one example embodiment, when assembled, the cap 1086 may be disposed between the over-cap 118 and the base 1014. The first cap side wall 202 may threadably engage the first neck portion 1050 of the base 1014 through threads 1028 and 1032. In this arrangement, the first cap side wall 202 may be seated in the second step 466 between the first neck portion 1050 and the second neck portion 354.

In at least one example embodiment, the over-cap 118 may be press-fit on the cap 1086 and second neck portion 354. Accordingly, the cap 1086 and the base 1014 may, as assembled, be in a press-fit arrangement with the over-cap 118 such that when the over-cap 118 is removed from the base 1014, the cap 1086 remains engaged with the base 1014.

Because of the press-fit arrangement, the disposal or storage compartment, i.e. second compartment 294, is easily accessed.

Figure 12:
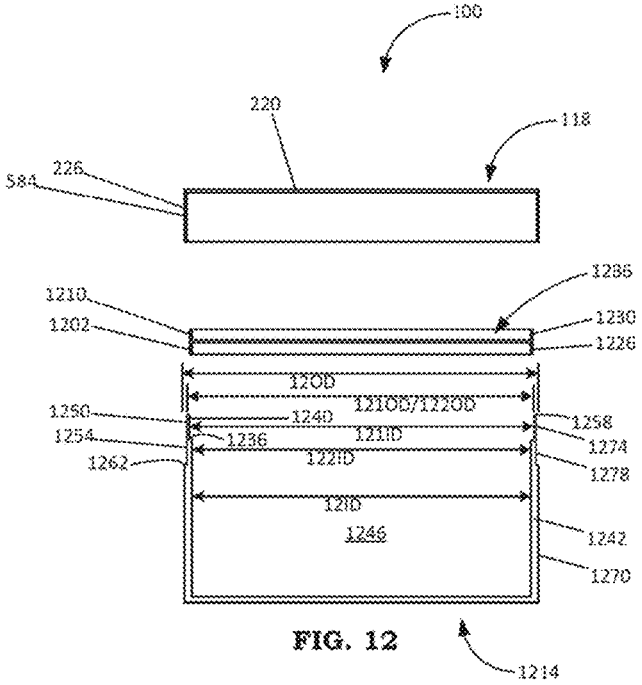
FIG. 12 is an exploded, cross-sectional view of at least one example embodiment of the container shown in FIG. 1A along line II-II.

FIG. 12 is an exploded, cross-sectional view of at least one example embodiment of the container shown in FIG. 1A along line II-II. FIG. 12 is generally the same as FIG. 4, except that FIG. 12 illustrates an alternative example embodiment of a cap 1286 and a base 1214.

In at least one example embodiment, a container 100 may include an over-cap 118, a base 1214, and a cap 1286. The over-cap 118, base 1214, and cap 1286 may be the same as, or similar to, the over-cap 118, the base 114, and the cap 286 of the container 100 except where described below.

In at least one example embodiment, the cap 1286 may be engaged to the base 1214. In at least one example embodiment, the base 1214 may include a first neck portion, or first neck, 1250 and a second neck portion, or second neck, 1254 on an open end 1258 of a side wall 1242. The first neck portion 1250 may be closer to the open end 1258 of the side wall 1242 than the second neck portion 1254, and the first neck portion 1250 may be directly adjacent to, or abutting, the second neck portion 1254.

The first neck portion 1250 may include a first neck outer diameter 121OD, and the second neck portion 1254 may include a second neck outer diameter 122OD. The first neck outer diameter 121OD and the second neck outer diameter 122OD may be the outer diameters of the respective neck portions. In at least one example embodiment, the diameter 120D of the side wall 1242 is greater than the second neck outer diameter 122OD and the first neck outer diameter 121OD, and the second neck outer diameter 122OD is equal to the first neck outer diameter 121OD.

In at least one example embodiment, an inner diameter 121ID of the first neck portion 1250 may be greater than an inner diameter 122ID of the second neck portion 1254 creating a step 1236 defining the first neck portion 1250. An inner diameter 12ID of the side wall 1242 of the base 1214 and the inner diameter 122ID of the second neck portion 1254 may remain constant to create a smooth-surfaced recess 1246.

Figure 13:
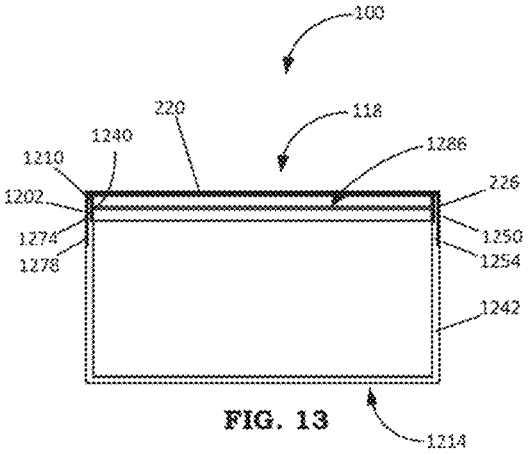
FIG. 13 is an assembled, cross-sectional view of at least one example embodiment of the container shown in FIG. 12.

FIG. 13 is an assembled, cross-sectional view of at least one example embodiment of the container shown in FIG. 12. FIG. 13 is generally the same as FIG. 12, but includes the features of the container 100 in a different view to provide a different perspective.

In at least one example embodiment, the cap 1286 may be press-fit (or, alternatively, threaded) on an inner surface 1240 of the first neck portion 1250 of the base 1214. When assembled, the first cap side wall 1202 may engage the step 1236 and the outer surface 1226 of the first cap side wall 1202 and the outer surface 1230 of the second cap side wall 1210 may engage the inner surface 1240 of the first neck portion 1250.

In at least one example embodiment, the over-cap 118 may be assembled to the base 1214 on outer surfaces 1274 and 1278 of the first neck portion 1250 and the second neck portion 1254, respectively. The over-cap side wall 226 may be press-fit onto the first neck portion 1250 and the second neck portion 1254 to retain the over-cap 118 on the base 1214. For example, the over-cap side wall 226 may be press-fit onto the first neck portion 1250 and the second neck portion 1254 until the over-cap side wall 226 abuts or engages the first step 1262. When the over-cap 118 is assembled on the base 1214, the outer surface 584 of the over-cap side wall 226 may be flush with an outer surface 1270 of the side wall 1242 of the base 1214.

Because of the press-fit arrangement, the disposal or storage compartment, (i.e. second compartment 294), is easily accessed.

In at least one alternative example embodiment, the over-cap 118 may be threadably engaged to the base 1214. For example, an inner surface of the over-cap side wall 226 may include threads that engage with threads on the outer surface 1274 of the first neck portion 1250 and the outer surface 1278 of the second neck portion 1254 of the base 1214.

In at least one example embodiment, the cap 1286 may be threadably engaged to the base 1214. For example, an outer surface of the first cap side wall 1202 and the second cap side wall 1210 may include threads that engage with threads on the inner surface of the first neck portion 1250 of the base 1214.

In an embodiment, the over-cap 118, 818 or the cap 286, 886, 1086, 1286 may include child-resistant features. For example, the child-resistant features may be a press-and-twist arrangement, or double-shell push removal arrangement, to open the over-cap 118, 818 or the cap 286, 886, 1086, 1286. In the case of the over-cap 118, 818, the entire over-cap 118, 818 must be pressed and turned in a counter-clockwise direction to disengage the over-cap 118, 818 from the base 114, 1014, 1214. For example, the child-resistant features may also be a rim snap arrangement, a squeeze and pull arrangement, a squeeze removal arrangement, etc.

Example embodiments have been disclosed herein, it should be understood that other variations may be possible. Such variations are not to be regarded as a departure from the spirit and scope of the present disclosure, and all such modifications as would be obvious to one skilled in the art are intended to be included within the scope of the following claims.

We claim:

1. A container configured to house a consumer product comprising:
- a base including,
  - a bottom wall, and
  - a side wall extending from the bottom wall, an open end of the side wall of the base including
    - a first neck portion, and
    - a second neck portion, the second neck portion defining a first step and the first neck portion defining a second step;
- a cap engaged with the base, the cap and the base defining
  - a first compartment, the cap including,
  - a cap top wall,
  - a first cap side wall extending from a bottom surface of the cap top wall, the first cap side wall configured to engage the second step, and
  - a second cap side wall extending from a top surface of the cap top wall; and
- an over-cap engaged with the base, the over-cap at least partially defining a second compartment, the over-cap including,
  - an over-cap top wall, and
  - an over-cap side wall extending from a bottom surface of the over-cap top wall, the over-cap side wall configured to engage the first step,
- wherein an outer surface of the first cap side wall and an outer surface of the second cap side wall are flush with an outer surface of the second neck portion of the base.

2. The container of claim 1, wherein the bottom wall of the base is circular and the side wall of the base is cylindrical.

3. The container of claim 1, wherein an outer surface of the over-cap side wall is flush with an outer surface of the side wall of the base.

4. The container of claim 1, wherein:

the first compartment is configured to house the consumer product, and the consumer product is a tobacco product.

5. The container of claim 1, wherein:

the first compartment is configured to house the consumer product, and the consumer product is a smokeless tobacco.

6. The container of claim 1, wherein the second compartment is above the first compartment.

7. The container of claim 1, wherein an inner surface of the first cap side wall extending from the bottom surface of the cap top wall engages an outer surface of the first neck portion of the base.

8. The container of claim 1, wherein:

the cap top wall of the cap is circular, the first cap side wall is cylindrical, and the second cap side wall is cylindrical.

9. The container of claim 1, wherein the over-cap top wall is circular and the over-cap side wall is cylindrical.

10. The container of claim 1, wherein the cap is press-fit on the base and the over-cap is press-fit on the cap and the base.

11. The container of claim 1, wherein the cap is threadably engaged with the base and the over-cap is press-fit on the cap and the base.

12. The container of claim 1, wherein:

the first neck portion includes a first neck outer diameter;

the second neck portion includes a second neck outer diameter; and the second neck outer diameter is greater than the first neck outer diameter.

13. The container of claim 12, wherein:

a depth of the second step is a difference between the second neck outer diameter and the first neck outer diameter.

14. The container of claim 12, wherein the side wall includes a side wall outer diameter, the side wall outer diameter greater than the second neck outer diameter.

15. The container of claim 14, wherein:

a depth of the first step is a difference between the side wall outer diameter and the second neck outer diameter.

16. The container of claim 1, wherein an inner diameter of the first neck portion is equal to an inner diameter of the second neck portion.

17. The container of claim 16, wherein the inner diameter of the first neck portion and the inner diameter of the second neck portion are less than an inner diameter of the side wall.

18. A container configured to house a consumer product comprising:

a base including, a bottom wall, and a side wall extending from the bottom wall, an open end of the side wall of the base including a first neck portion, and a second neck portion, the second neck portion defining a first step and the first neck portion defining, a second step;

a cap engaged with the base, the cap and the base defining a first compartment, the cap including:

a cap top wall, a first cap side wall extending from a bottom surface of the cap top wall, the first cap side wall configured to engage the second step, and a second cap side wall extending from a top surface of the cap top wall; and an over-cap engaged with the base, the over-cap at least partially defining a second compartment, the over-cap including, an over-cap top wall, and an over-cap side wall extending from a bottom surface of the over-cap top wall, the over-cap side wall configured to engage the first step, wherein a thickness of the first cap side wall plus a thickness of the first neck portion is equal to a thickness of the second neck portion.

* * * * *